US011547229B1

(12) United States Patent
Soares De Oliveira

(10) Patent No.: US 11,547,229 B1
(45) Date of Patent: Jan. 10, 2023

(54) CUP HOLDER

(71) Applicant: Lirian Soares De Oliveira, New York, NY (US)

(72) Inventor: Lirian Soares De Oliveira, New York, NY (US)

( * ) Notice: Subject to any disclaimer, the term of this patent is extended or adjusted under 35 U.S.C. 154(b) by 0 days.

(21) Appl. No.: 17/329,336

(22) Filed: May 25, 2021

Related U.S. Application Data

(63) Continuation-in-part of application No. 16/989,964, filed on Aug. 11, 2020, now abandoned.

(51) Int. Cl.
*A47G 23/02* (2006.01)
*A45C 11/18* (2006.01)
*A45C 11/00* (2006.01)

(52) U.S. Cl.
CPC ..... *A47G 23/0216* (2013.01); *A45C 11/182* (2013.01); *A45C 2011/002* (2013.01); *A45C 2200/20* (2013.01)

(58) Field of Classification Search
CPC ..... A45F 2200/0583; A45F 2005/006; A45F 5/021; A45F 2005/002; A47G 2023/0675; A47G 23/0216; A47G 23/0675
USPC ..... 224/576–577, 930
See application file for complete search history.

(56) References Cited

U.S. PATENT DOCUMENTS 4,557,452 A * 12/1985 Khuong ..... A47G 23/0225 248/214
5,249,770 A * 10/1993 Louthan ..... A47K 1/09 248/230.8
5,328,143 A * 7/1994 Koorey ..... B60N 3/106 224/549
5,601,268 A * 2/1997 Dunchock ..... B60N 3/106 248/311.2
7,300,031 B2 * 11/2007 Bertsch ..... A47G 23/0225 248/223.41
8,070,026 B2 * 12/2011 Wadsworth ..... F16M 11/105 224/269
9,295,320 B1 * 3/2016 McManus ..... A45F 5/021
9,516,941 B1 * 12/2016 Moulton ..... A47G 23/0216
9,749,727 B2 * 8/2017 Tews ..... H04R 1/1008
10,307,006 B2 * 6/2019 Knoll ..... B67B 7/16
2007/0157500 A1 * 7/2007 Wolfe ..... G09F 7/10 40/781
2008/0263918 A1 * 10/2008 Doughty ..... G07F 9/10 40/124.06
2011/0089077 A1 * 4/2011 Ziemba ..... B65D 71/00 206/229
2019/0053612 A1 * 2/2019 Santini ..... A45F 5/02
2020/0113320 A1 * 4/2020 Simpson ..... H04B 1/3888

* cited by examiner

*Primary Examiner* — Adam J Waggenspack
(74) *Attorney, Agent, or Firm* — Kyle A. Fletcher, Esq.

(57) ABSTRACT

The cup holder comprises a backing board, an upper cup arm, a lower cup arm, a phone holder, a front card holder, and a rear card holder. The cup holder may be adapted to hold a cup, a cell phone, cards, or combinations thereof. The upper cup arm and the lower cup arm may be moved between an open position and a closed position. The cup may be held by the upper cup arm and by the lower cup arm when the upper cup arm and the lower cup arm are moved to the open position. The cards may be held in the front card holder and/or the rear card holder. As non-limiting examples, the cards may comprise one or more of a credit card, a debit card, a business card, an ID card, a name tag, a driver license, or combinations thereof.

17 Claims, 6 Drawing Sheets

CUP HOLDER

CROSS REFERENCES TO RELATED APPLICATIONS

This continuation-in-part application claims priority to U.S. Non-provisional patent application Ser. No. 16/989,964 that was filed on Aug. 11, 2020.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of cup holders and personal organizers, more specifically, a cup holder comprising a phone holder and a pair of card holders.

SUMMARY OF INVENTION

The cup holder comprises a backing board, an upper cup arm, a lower cup arm, a phone holder, a front card holder, and a rear card holder. The cup holder may be adapted to hold a cup, a cell phone, cards, or combinations thereof. The upper cup arm and the lower cup arm may be operable to move between an open position and a closed position. The cup may be held by the upper cup arm and by the lower cup arm when the upper cup arm and the lower cup arm are moved to the open position. The cards may be held in the front card holder and/or the rear card holder. As non-limiting examples, the cards may comprise one or more of a credit card, a debit card, a business card, an ID card, a name tag, a driver license, or combinations thereof.

An object of the invention is to provide a collapsible cup holder.

Another object of the invention is to provide a phone holder.

A further object of the invention is to provide a pair of card holders.

Yet another object of the invention is to provide viewing access to an object in the front card holder via a display area.

These together with additional objects, features and advantages of the cup holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the cup holder in detail, it is to be understood that the cup holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the cup holder.

It is therefore important that the claims be regarded as including such equivalent construction insofar as they do not depart from the spirit and scope of the cup holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
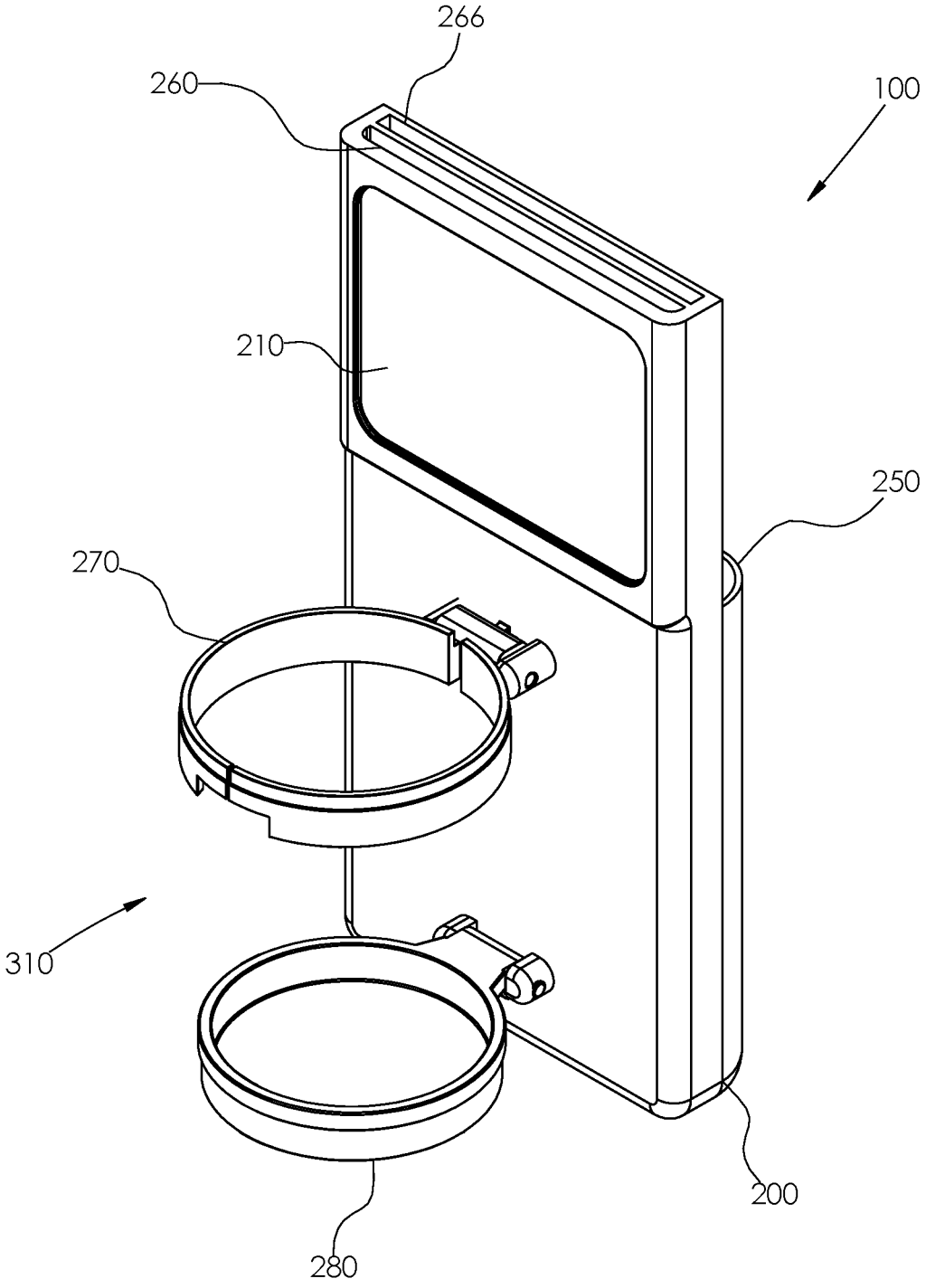
FIG. 1 is an isometric view of an embodiment of the disclosure.
Figure 2:
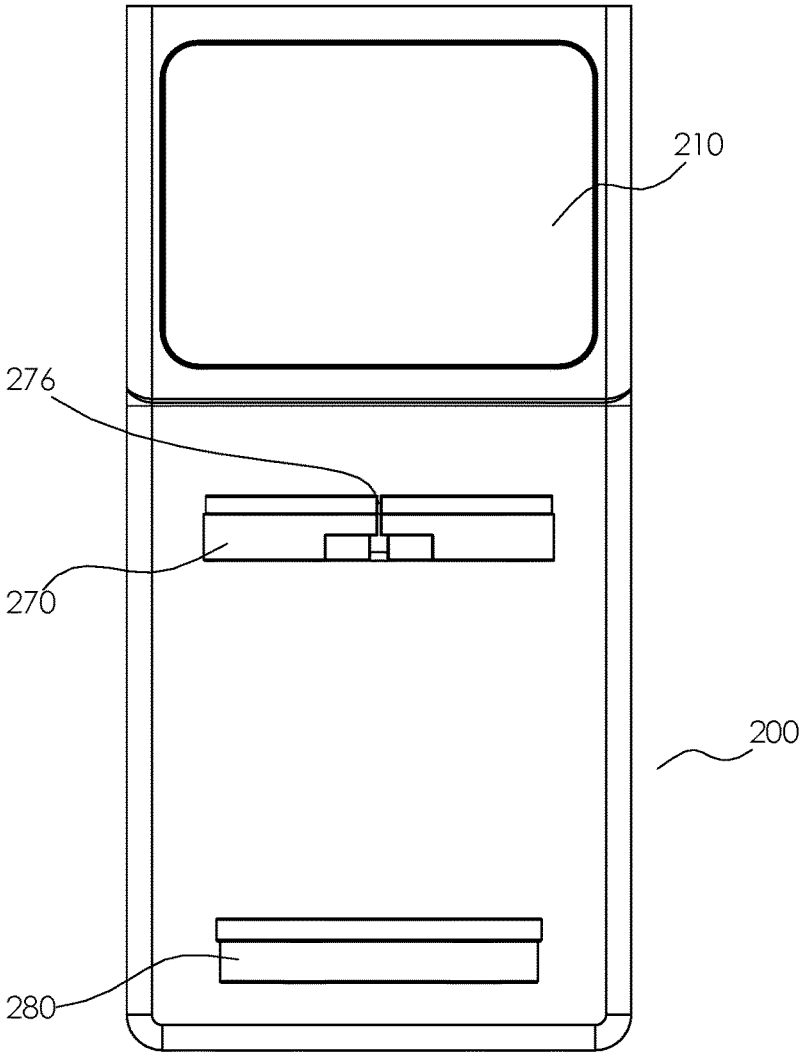
FIG. 2 is a front view of an embodiment of the disclosure illustrating the upper cup arm and lower cup arm in the open position.
Figure 3:
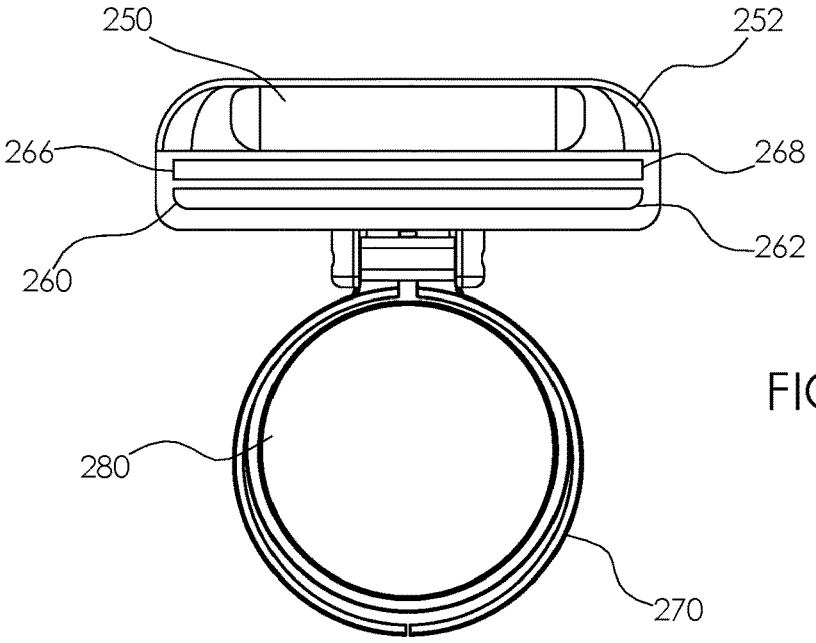
FIG. 3 is a top view of an embodiment of the disclosure.
Figure 4:
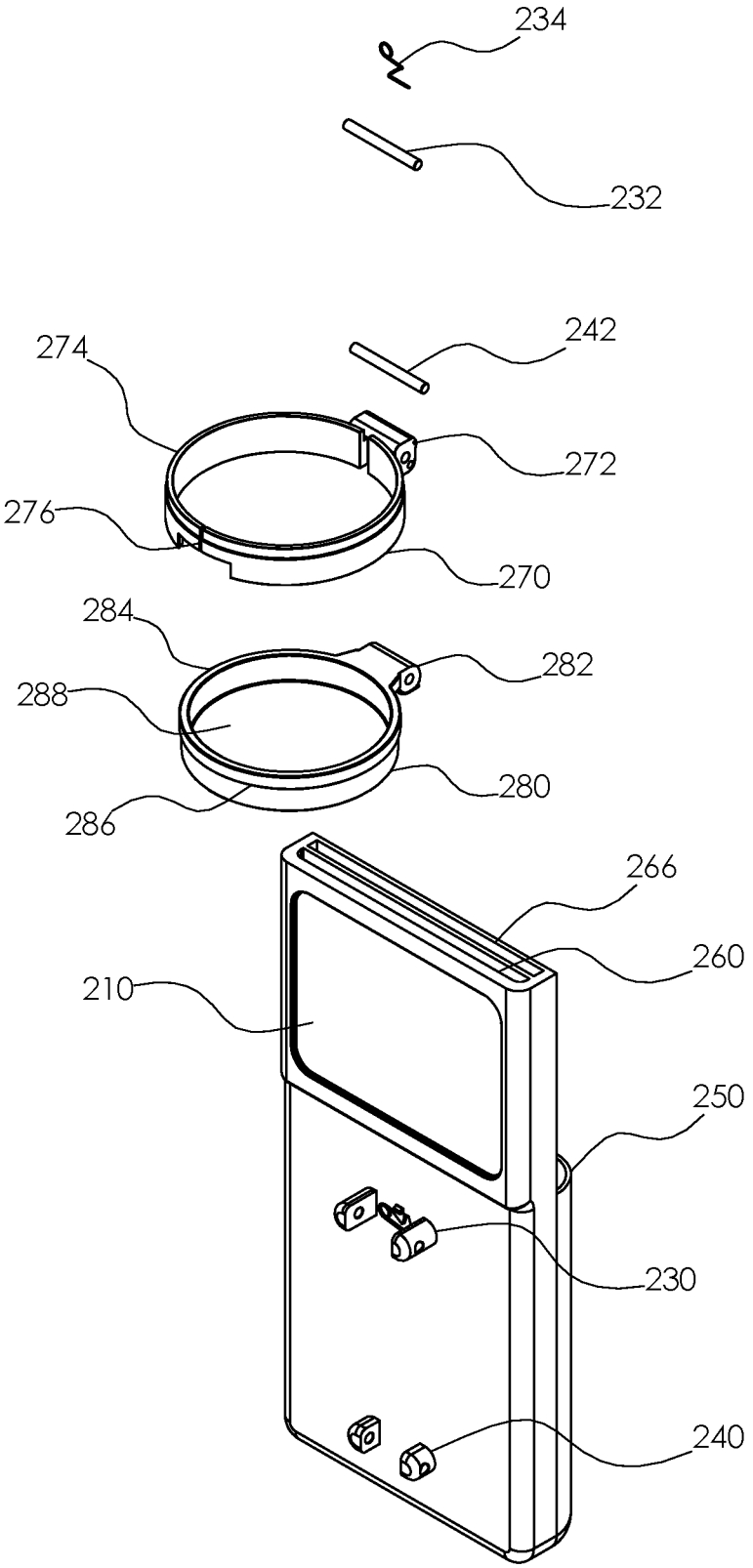
FIG. 4 is an exploded view of an embodiment of the disclosure.
Figure 5:
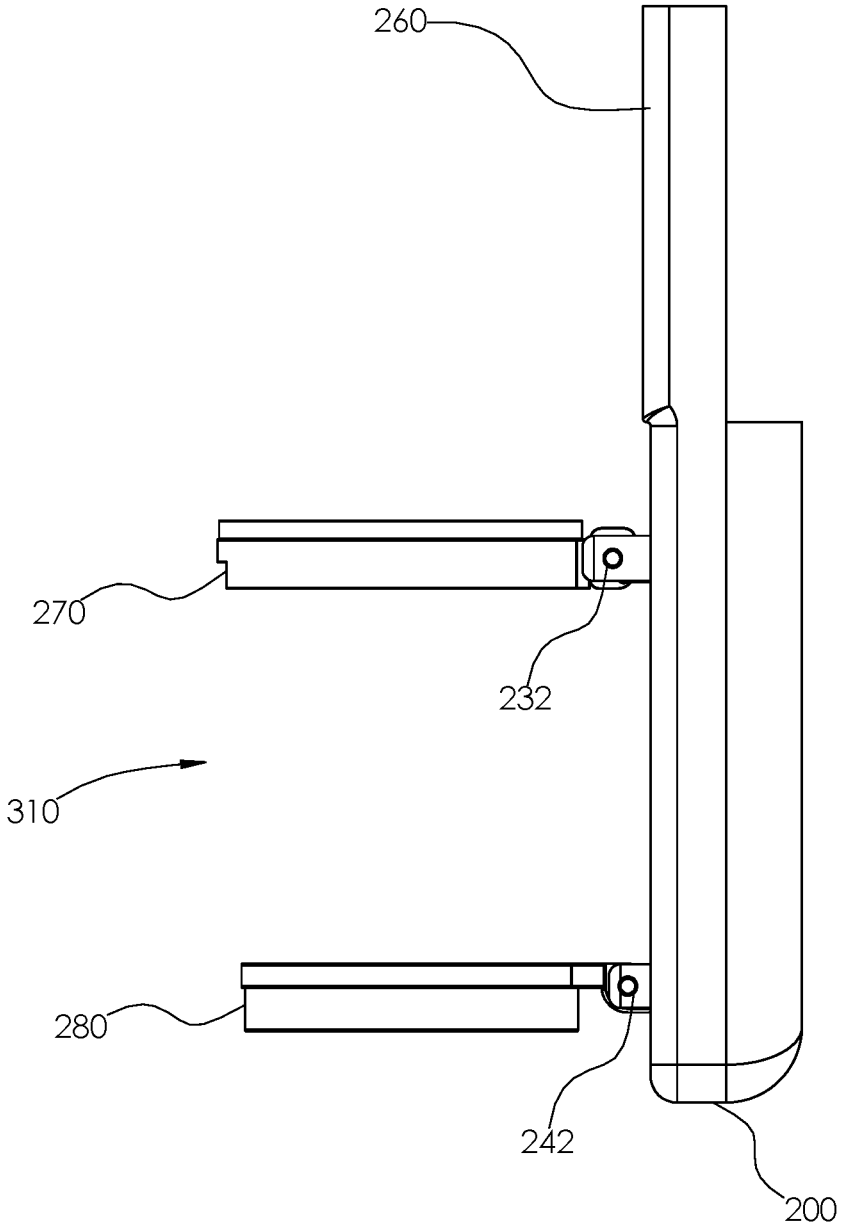
FIG. 5 is a side view of an embodiment of the disclosure illustrating the upper cup arm and lower cup arm in the open position.
Figure 6:
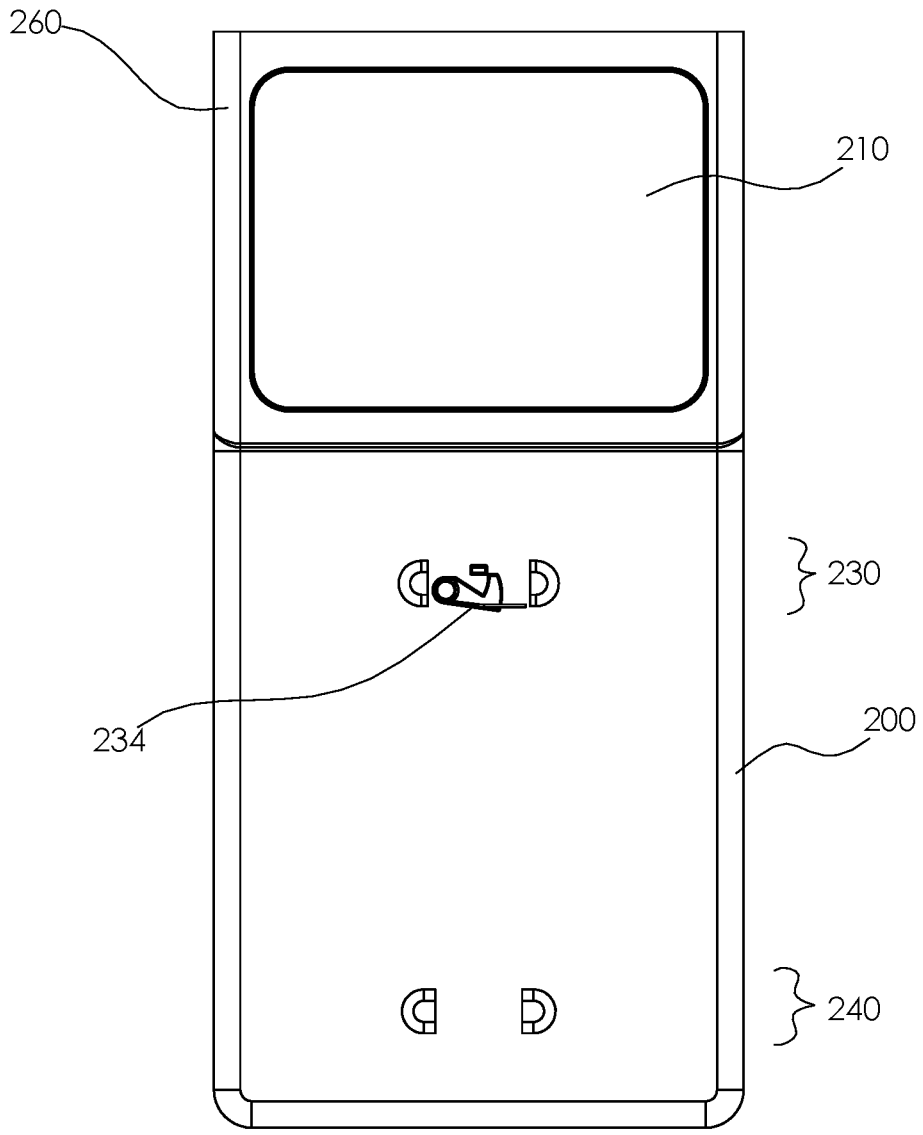
FIG. 6 is a detail view of an embodiment of the disclosure illustrating the front of the invention with the upper cup arm and lower cup arm removed to show the location of the spring.
Figure 7:
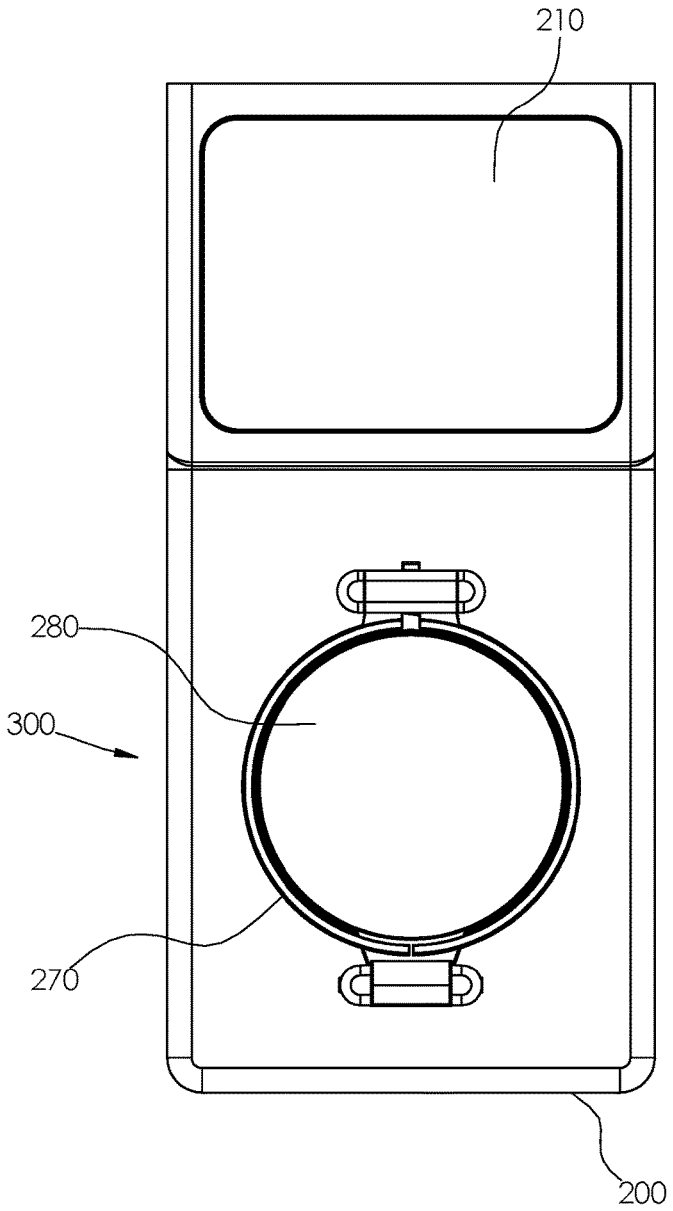
FIG. 7 is a front view of a second embodiment of the disclosure illustrating the upper cup arm and lower cup arm in the closed position.
Figure 8:
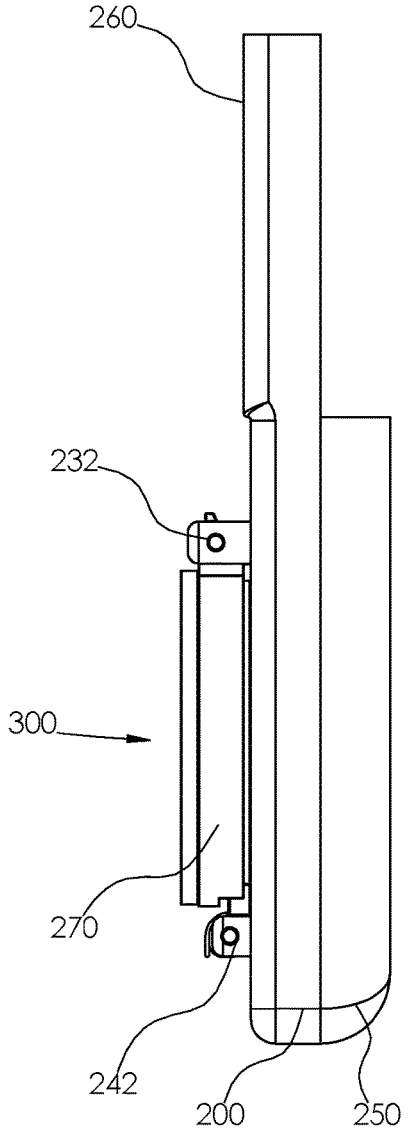
FIG. 8 is a side view of an embodiment of the disclosure illustrating the upper cup arm and lower cup arm in the closed position.

Detailed reference will now be made to a first potential embodiment of the disclosure, which is illustrated in FIGS. 1 through 8.

The cup holder 100 (hereinafter invention) comprises a backing board 200, an upper cup arm 270, a lower cup arm 280, a phone holder 250, a front card holder 260, and a rear card holder 266. The invention 100 may be adapted to hold a cup, a cell phone, cards, or combinations thereof. The upper cup arm 270 and the lower cup arm 280 may individually be moved between an open position 310 and a closed position 300. The cup may be held by the upper cup arm 270 and by the lower cup arm 280 when the upper cup arm 270 and the lower cup arm 280 are moved to the open position 310. The cards may be held in the front card holder 260 and/or the rear card holder 266. As non-limiting examples, the cards may comprise one or more of a credit card, a debit card, a business card, an ID card, a name tag, a driver license, or combinations thereof.

The backing board 200 may be a rigid plate that provides structural support for the weight of the cup. The backing board 200 may comprise an upper hinge base 230 and a lower hinge base 240. The upper hinge base 230 may hingedly couple to the upper cup arm 270. The lower hinge base 240 may hingedly couple to the lower cup arm 280. The upper hinge base 230 and the lower hinge base 240 may be located on the front of the backing board 200. The lower hinge base 240 may be located below the upper hinge base 230.

The upper hinge base 230 may be one or more first outward projections of the backing board 200. The upper cup arm 270 may hingedly couple to the upper hinge base 230. The upper hinge base 230 may comprise an upper hinge pin 232. The upper hinge pin 232 may couple the upper cup arm 270 to the upper hinge base 230 by passing through the upper cup arm 270 and the upper hinge base 230. The upper hinge pin 232 may be operable as a pivot point for the upper cup arm 270.

The upper hinge base 230 may further comprise a spring 234. The spring 234 may exert a spring force against the upper cup arm 270 relative to the backing board 200. The spring 234 may be bistable such that the spring 234 may come to rest in either of two rest states. In a first rest state, the spring 234 may retain the upper cup arm 270 in the open position 310 once the upper cup arm 270 has been moved to the open position 310. In a second rest state, the spring 234 may retain the upper cup arm 270 in the closed position 300 once the upper cup arm 270 has been moved to the closed position 300. The upper cup arm 270 may be operable to move between the open position 310 and the closed position 300 by the application of an external force to move the upper cup arm 270.

The lower hinge base 240 may be one or more second outward projections of the backing board 200. The lower cup arm 280 may hingedly couple to the lower hinge base 240. The lower hinge base 240 may comprise a lower hinge pin 242. The lower hinge pin 242 may couple the lower cup arm 280 to the lower hinge base 240 by passing through the lower cup arm 280 and the lower hinge base 240. The lower hinge pin 242 may be operable as a pivot point for the lower cup arm 280.

The upper cup arm 270 may comprise an upper cup aperture 274 and an upper hinge 272. The upper cup arm 270 may pivot at the upper hinge 272 between the open position 310 and the closed position 300. The upper cup arm 270 may extend horizontally forward from the upper hinge 272 and perpendicular to the backing board 200 when in the open position 310. The upper cup arm 270 may extend vertically downward from the upper hinge 272 and parallel to the backing board 200 when in the closed position 300. The upper cup arm 270 may be operable to support the upper half of the cup when the upper cup arm 270 is in the open position 310. The upper cup aperture 274 may surround the cup and may prevent the cup from falling when the upper cup arm 270 is in the open position 310 and the cup is placed into the upper cup aperture 274.

The upper cup arm 270 may comprise a gap 276 and may be made from a flexible material. If the cup that in placed into the invention 100 has a diameter than is larger than the diameter of the upper cup aperture 274, the sides of the upper cup arm 270 may flex outward to enlarge the gap 276 and, by doing so, increase the diameter of the upper cup aperture 274 to accommodate the cup. When the oversized cup is removed from the invention 100, the sides of the upper cup arm 270 may return to their original positions.

The lower cup arm 280 may comprise a lower cup aperture 284 and a lower hinge 282. The lower cup arm 280 may pivot at the lower hinge 282 between the open position 310 and the closed position 300. The lower cup arm 280 may extend horizontally forward from the lower hinge 282 and perpendicular to the backing board 200 when in the open position 310. The lower cup arm 280 may extend vertically upward from the lower hinge 282 and parallel to the backing board 200 when in the closed position 300. The lower cup arm 280 may be operable to support the lower half of the cup when the lower cup arm 280 is in the open position 310. The lower cup aperture 284 may surround the cup and may prevent the cup from falling when the lower cup arm 280 is in the open position 310 and the cup is placed into the lower cup aperture 284.

The lower cup arm 280 may comprise a lower cup rim 286 and a bottom plate 288. The top of the lower cup rim 286 may define the lower cup aperture 284. The bottom plate 288 may couple to the bottom of the lower cup arm 280 to enclose the bottom of the lower cup arm 280.

The lower cup arm 280 may be pivoted upwards prior to pivoting the upper cup arm 270 downwards when the invention 100 is placed into the closed position 300. In the closed position 300, the upper cup arm 270 may surround the lower cup arm 280 such that the lower cup rim 286 is nested within the upper cup arm 270.

The phone holder 250 may be a pocket located on the lower rear of the backing board 200. The phone holder 250 may comprise a phone aperture 252 at the top of the phone holder 250 through which the cell phone may be inserted into and removed from the phone holder 250.

The front card holder 260 may be a compartment coupled to the upper front of the backing board 200. The front card holder 260 may comprise a front card aperture 262 at the top of the front card holder 260 through which the cards may be inserted into and removed from the front card holder 260. The front card holder 260 may comprise a display area 210. The display area 210 may be a transparent window located on the front of the front card holder 260 such that an individual card contained within the front card holder 260 is visible through the display area 210.

The rear card holder 266 may be a compartment located within the top of the backing board 200. The rear card holder 266 may comprise a rear card aperture 268 at the top of the rear card holder 266 through which the cards may be inserted into and removed from the rear card holder 266.

In some embodiments, the phone holder 250, the front card holder 260, or both may be made of a flexible material such that the phone holder 250, the front card holder 260, or both may expand to accommodate items.

In use, a user may place the invention 100 where it may hold a cup. As non-limiting examples, the invention 100 may be mounted to a wall or worn on a lanyard. An upper cup arm 270 and a lower cup arm 280 may be moved from a closed position 300 to an open position 310 in preparation for holding the cup. The cup may be lowered into the upper cup arm 270 and the lower cup arm 280 from above to free the hands of the user. Once the cup has been removed from the upper cup arm 270 and the lower cup arm 280, the upper cup arm 270 and the lower cup arm 280 may be moved to the closed position 300.

The user may place cards into a front card holder 260 and a rear card holder 266 as a way of transporting or storing the cards. The cards may be placed into and removed from the front card holder 260 and the rear card holder 266 via a front card aperture 262 and a rear card aperture 268, respectively. An individual card placed into the front card holder 260 may be visible through a display area 210 of the front card holder 260. As a non-limiting example, the individual card may be a name tag to identify the owner of the cup or to identify the user wearing the invention 100.

The user may place a cell phone into a phone holder 250 as a way of transporting or storing the cell phone. The cell phone may be placed into the phone holder 250 via a phone aperture 252.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hinge" may be a device that permits the turning, rotating, or pivoting of a first object relative to a second object.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, a "pocket" may be a pouch or storage space that is formed into an object.

As used herein, "rigid" may refer to an object or material which is inflexible. A rigid object may break if force is applied to the object.

As used in this disclosure, a "rim" may be an outer edge or border that follows along the perimeter of an object.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "transparent" may refer to a material that allows light to pass through the material without significant scattering such that an object can be clearly seen through the material.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cup holder comprising:

a backing board, an upper cup arm, a lower cup arm, a phone holder, a front card holder, and a rear card holder;

wherein the cup holder is adapted to hold a cup, a cell phone, cards, or combinations thereof against a wall;

wherein the upper cup arm and the lower cup arm are operable to move between an open position and a closed position;

wherein the cup is held by the upper cup arm and by the lower cup arm when the upper cup arm and the lower cup arm are moved to the open position;

wherein cards are optionally held in the front card holder and/or the rear card holder;

wherein the backing board comprises an upper hinge base and a lower hinge base;

wherein the upper hinge base comprises an upper hinge pin;

wherein the upper hinge pin couples the upper cup arm to the upper hinge base by passing through the upper cup arm and the upper hinge base;

wherein the upper hinge pin is operable as a pivot point for the upper cup arm;

wherein the upper hinge base further comprises a spring;

wherein the spring exerts a spring force against the upper cup arm relative to the backing board;

wherein the spring is bistable such that the spring comes to rest in either of two rest states;

wherein the upper cup arm comprises an upper cup aperture and an upper hinge;

wherein the upper cup arm pivots at the upper hinge between the open position and the closed position;

wherein the phone holder is a pocket located on the lower rear of the backing board.

2. The cup holder according to claim 1
wherein the backing board is a rigid plate that supports the cup.

3. The cup holder according to claim 2
wherein the upper hinge base hingedly couples to the upper cup arm;
wherein the lower hinge base hingedly couples to the lower cup arm;
wherein the upper hinge base and the lower hinge base are located on the front of the backing board;
wherein the lower hinge base is located below the upper hinge base.

4. The cup holder according to claim 3
wherein the upper hinge base is one or more first outward projections of the backing board;
wherein the upper cup arm hingedly couples to the upper hinge base.

5. The cup holder according to claim 4
wherein in a first rest state, the spring retains the upper cup arm in the open position once the upper cup arm has been moved to the open position;
wherein in a second rest state, the spring retains the upper cup arm in the closed position once the upper cup arm has been moved to the closed position;
wherein the upper cup arm can be moved between the open position and the closed position by the application of an external force to move the upper cup arm.

6. The cup holder according to claim 5
wherein the lower hinge base is one or more second outward projections of the backing board;
wherein the lower cup arm hingedly couples to the lower hinge base.

7. The cup holder according to claim 6
wherein the lower hinge base comprises a lower hinge pin;
wherein the lower hinge pin couples the lower cup arm to the lower hinge base by passing through the lower cup arm and the lower hinge base;
wherein the lower hinge pin is operable as a pivot point for the lower cup arm.

8. The cup holder according to claim 7
wherein the upper cup arm extends horizontally forward from the upper hinge and perpendicular to the backing board when in the open position;
wherein the upper cup arm extends vertically downward from the upper hinge and parallel to the backing board when in the closed position;
wherein the upper cup arm is operable to support the upper half of the cup when the upper cup arm is in the open position;
wherein the upper cup aperture surrounds the cup and prevents the cup from falling when the upper cup arm is in the open position and the cup is placed into the upper cup aperture.

9. The cup holder according to claim 8
wherein the upper cup arm comprises a gap and is made from a flexible material;
wherein if the cup that is placed into the cup holder has a diameter that is larger than the diameter of the upper cup aperture, the sides of the upper cup arm flex outward to enlarge the gap and increase the diameter of the upper cup aperture to accommodate the cup.

10. The cup holder according to claim 9
wherein the lower cup arm comprises a lower cup aperture and a lower hinge;
wherein the lower cup arm pivots at the lower hinge between the open position and the closed position;
wherein the lower cup arm extends horizontally forward from the lower hinge and perpendicular to the backing board when in the open position;
wherein the lower cup arm extends vertically upward from the lower hinge and parallel to the backing board when in the closed position;
wherein the lower cup arm is operable to support the lower half of the cup when the lower cup arm is in the open position;
wherein the lower cup aperture surrounds the cup.

11. The cup holder according to claim 10
wherein the lower cup arm comprises a lower cup rim and a bottom plate;
wherein the top of the lower cup rim defines the lower cup aperture;
wherein the bottom plate couples to the bottom of the lower cup arm to enclose the bottom of the lower cup arm.

12. The cup holder according to claim 11
wherein the lower cup arm can pivot upwards prior to pivoting the upper cup arm downwards when the cup holder is placed into the closed position;
wherein in the closed position, the upper cup arm surrounds the lower cup arm such that the lower cup rim is nested within the upper cup arm.

13. The cup holder according to claim 12
wherein the phone holder comprises a phone aperture at the top of the phone holder through which the cell phone can be inserted into and removed from the phone holder.

14. The cup holder according to claim 13
wherein the front card holder is a compartment coupled to the upper front of the backing board;
wherein the front card holder comprises a front card aperture at the top of the front card holder through which the cards are inserted into and removed from the front card holder.

15. The cup holder according to claim 14
wherein the front card holder comprises a display area;
wherein the display area is a transparent window located on the front of the front card holder such that an individual card contained within the front card holder is visible through the display area.

16. The cup holder according to claim 15
wherein the rear card holder comprises a rear card aperture at the top of the rear card holder through which the cards are inserted into and removed from the rear card holder.

17. The cup holder according to claim 16
wherein the phone holder, the front card holder, or both are made of a flexible material such that the phone holder, the front card holder, or both expand.

* * * * *